US005813834A

United States Patent [19]

Hopfensperger et al.

[11] Patent Number: 5,813,834

[45] Date of Patent: Sep. 29, 1998

[54] CENTRIFUGAL FAN

[75] Inventors: Reinhold Hopfensperger, Magersdorf; Rudolf Tungl, Ergolding, both of Germany

[73] Assignee: Motoren Ventilatoren Landshut GmbH, Landshut, Germany

[21] Appl. No.: 784,007

[22] Filed: Jan. 15, 1997

[30] Foreign Application Priority Data

Jan. 24, 1996 [DE] Germany ..... 196 02 368.8

[51] Int. Cl.[6] ..... F04D 29/44

[52] U.S. Cl. ..... 415/206

[58] Field of Search ..... 415/203, 204, 415/206

[56] References Cited

U.S. PATENT DOCUMENTS 3,824,028 7/1974 Zenker et al. .

FOREIGN PATENT DOCUMENTS 0 410 271 A 1/1991 European Pat. Off. .

354 493 10/1905 France .

976 210 3/1951 France .

2 417 661 1/1979 France .

1 428 055 7/1969 Germany .

33 10 376 A1 9/1984 Germany .

2 055 969 3/1981 United Kingdom .

OTHER PUBLICATIONS

"Motoren und Lufter", Alcatel Sel, Standard Elektrik Lorenz AG, 1992, 6650/3643 D–1.92–1.5 SD.

*Primary Examiner*—John T. Kwon

*Attorney, Agent, or Firm*—Frishauf, Holtz, Goodman, Langer & Chick

[57] ABSTRACT

An improved centrifugal fan whose air capacity is to be increased, without changing the dimensions of the casing and without using a higher-powered motor improves the fan by a) reducing the volume of the pressure space by enlarging the impeller diameter, b) shifting a location of a least distance between the impeller and the casing in the direction of rotation of the impeller, c) forming a wedge-shaped space ahead of the location of the least distance, and d) providing the impeller with very flat blades. The centrifugal fan has a higher air capacity at a lower rpm.

13 Claims, 4 Drawing Sheets n=f(V̇)
Δp=f(V̇)
1/min
Pa
3000
2600
2200
1800
1400
400
350
300
250
200
150
100
50
0
n
Δp
0
4
8
12
16
20
24
28
32
36
40
V̇
l/s

CENTRIFUGAL FAN

FIELD OF THE INVENTION

The invention relates to a centrifugal fan having a casing with a spiral-shaped outer contour, at least one circular lateral inlet opening, and a tangential outlet opening, and a drum impeller rotatably mounted on the casing and coupled to an electric motor, in such a way that a pressure space is formed between the circumference of the impeller and the inner contour of the casing.

BACKGROUND

Such a centrifugal fan is known (prospectus entitled "L üfter" [Fan] published by Applicant in 1992). In this reference, a centrifugal fan having the type designation RL 108 is described on page 67; its casing has an external height of 170 mm and a width of 162.5 mm. The diameter of the impeller is 108 mm.

By way of example, the known centrifugal fan is used in relatively large numbers in gas heating appliances on the gas exhaust side. Since the appliances in which these centrifugal fans are used undergo constant further development, particularly with the goal of more-compact appliances, there is a need for centrifugal fans of this kind with a higher air capacity but unchanged dimensions. The technological object of the invention is therefore to create such a centrifugal fan. The new centrifugal fan should have about the same fan efficiency as the prior art and be no noisier than the prior art. Hence it should have a higher specific output over a wide range of the characteristic curve, that is, from 0 to approximately 80% of the total volumetric flow.

SUMMARY OF THE INVENTION:

This object is attained according to the invention by a centrifugal fan having the following characteristics:

a) the volume of the pressure space is reduced by increasing the impeller diameter;

b) the shortest distance between the circumference of the impeller and the inner contour of the casing is greatly reduced;

c) the location of the shortest distance between the circumference of the impeller and the inner contour of the casing is offset in the direction of rotation of the impeller from the outlet opening;

d) the distance between the circumference of the impeller and the inner contour of the casing increases steadily from the location of the shortest distance toward the outlet opening, forming a wedge-shaped space;

e) the impeller is equipped with very flat blades.

A centrifugal fan with these characteristics has a higher air capacity and a comparable efficiency, with the same mechanical outer dimensions.

Advantageous details of the invention are described below in conjunction with FIGS. 1–6.

DRAWINGS

FIG. 1, the cross section through the known centrifugal fan;

FIG. 2, the cross section through an exemplary embodiment of the centrifugal fan of the invention;

FIG. 3, a modification of the centrifugal fan of FIG. 2;

FIG. 4, the definition of the blade angle;

FIG. 5, the characteristic curve of an exemplary embodiment of the centrifugal fan of the invention, in comparison with a known centrifugal fan; and FIG. 6, the location of the inflow opening in an exemplary embodiment of the centrifugal fan.

DETAILED DESCRIPTION

Figure 1:
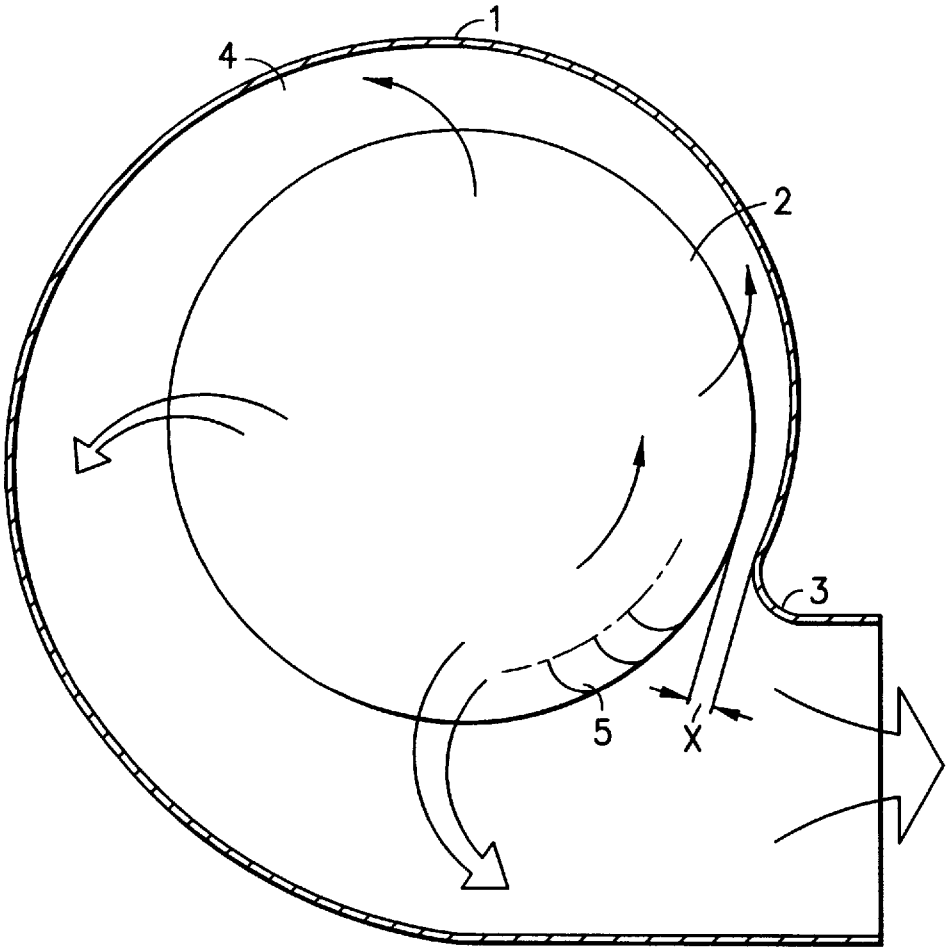
FIG.1 PRIOR ART

As can be seen from FIG. 1, a centrifugal fan has a casing 1 with a spiral outer contour. In the casing 1, the drum impeller 2 is located ahead of a circular intake opening. In the known centrifugal fan, the narrowest point x between the circumference of the impeller 2 and the casing 1 is located directly at the casing tongue 3, or in other words at the point where the semicircular arc of the casing tongue 3 changes over to the spiral. Beginning at the narrowest point x, a progressively larger pressure space 4 is present in the direction of rotation; it acts as a diffusor for the flow emerging at high speed between the blades 5. The distance, i.e. spacing, between the circumference of the impeller 2 and the casing 1 at the narrowest point x is typically at least 4 to 5% of the impeller diameter, for the sake of avoiding undesired noise.

Figure 2:
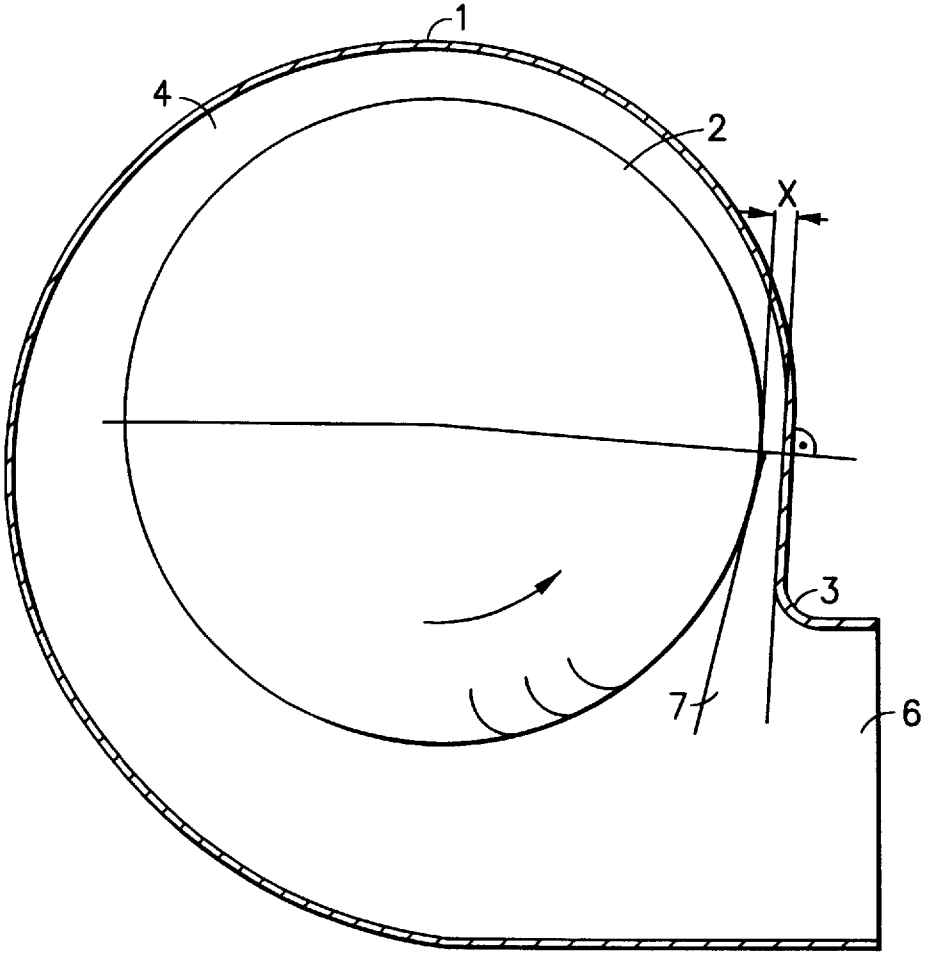

FIG. 2 shows an exemplary embodiment of the centrifugal fan of the invention. In comparison with the centrifugal fan of FIG. 1, the centrifugal fan shown in FIG. 2 has an impeller with a larger diameter. If the aforementioned casing dimensions of the known centrifugal fan, which are not to be altered, is taken as the point of departure, then in this exemplary embodiment the impeller diameter is 120 mm. Since the location of the axial center of the impeller, which corresponds to the location of the drive shaft and also approximately to the center of the circular inlet nozzle, is not substantially altered, the casing scroll in the region of the outlet opening 6 is varied in such a way that the outlet shaft is shorter. Moreover, the narrowest point x between the circumference of the impeller 2 and the casing 1 is made greatly smaller and is shifted in the direction of rotation of the impeller. Ahead of it is a spacing that increases toward the outlet opening 6, forming a sharp-pointed wedge-shaped space 7.

Figure 3:
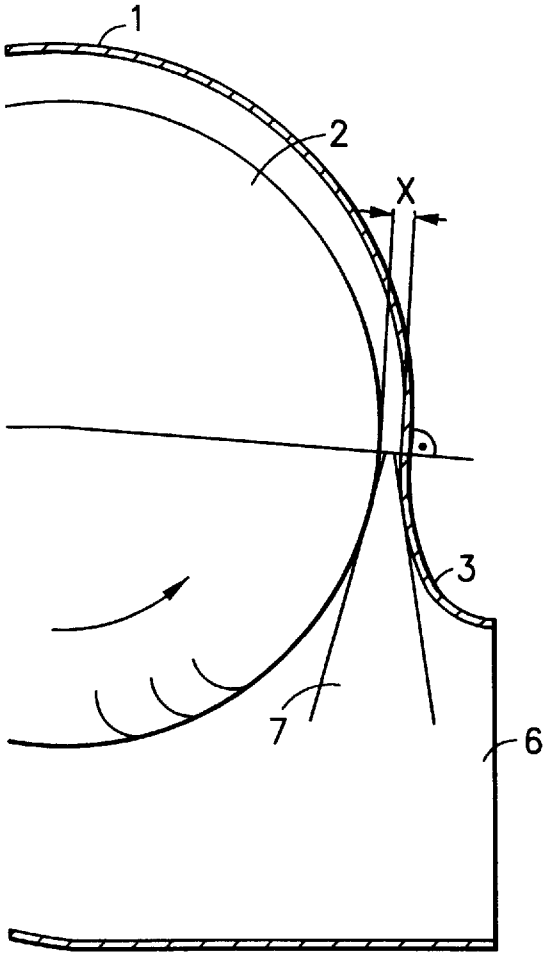

The embodiment of the centrifugal fan shown in FIG. 3 differs from that of FIG. 2 in that the casing tongue 3 below the narrowest point x is bent farther away from the circumference of the impeller 2, so that the wedge-shaped space has a larger angle.

Figure 4:
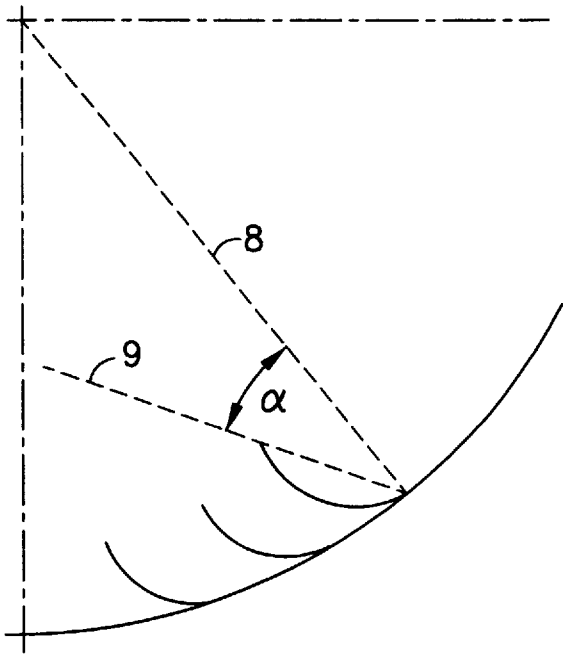

FIG. 4 shows how the blade angle $\alpha$ is defined. The blade angle $\alpha$ is located between the line 8 from the center to the circumference of the impeller 2 (radius) and the secant 9 to the blades 5.

Figure 5:
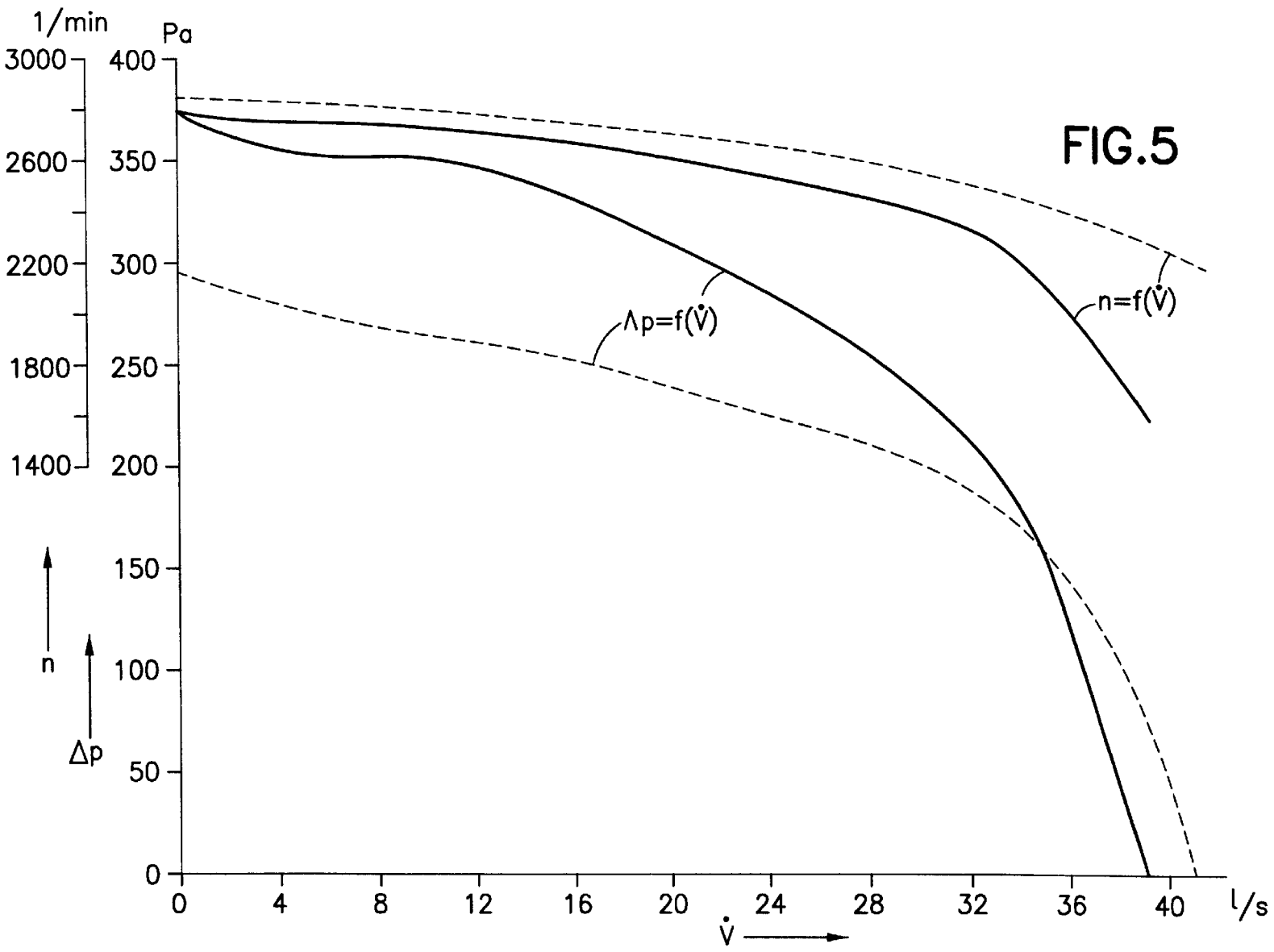

In FIG. 5, the improved properties of the centrifugal fan of the invention are illustrated in terms of a comparison of characteristic curves. The characteristic curves shown in solid lines are the characteristic curves of the centrifugal fan of the invention; the dashed lines are the characteristic curves of the corresponding known centrifugal fan. The graph shows both the pressure-volume characteristic curves, that is, the static differential pressure $\Delta P$ as a function of the volumetric flow V, and the dependency of the rpm n on the volumetric flow V. The characteristic curves show that with the centrifugal fan of the invention, a higher air capacity at lower rpm is generated.

Figure 6:
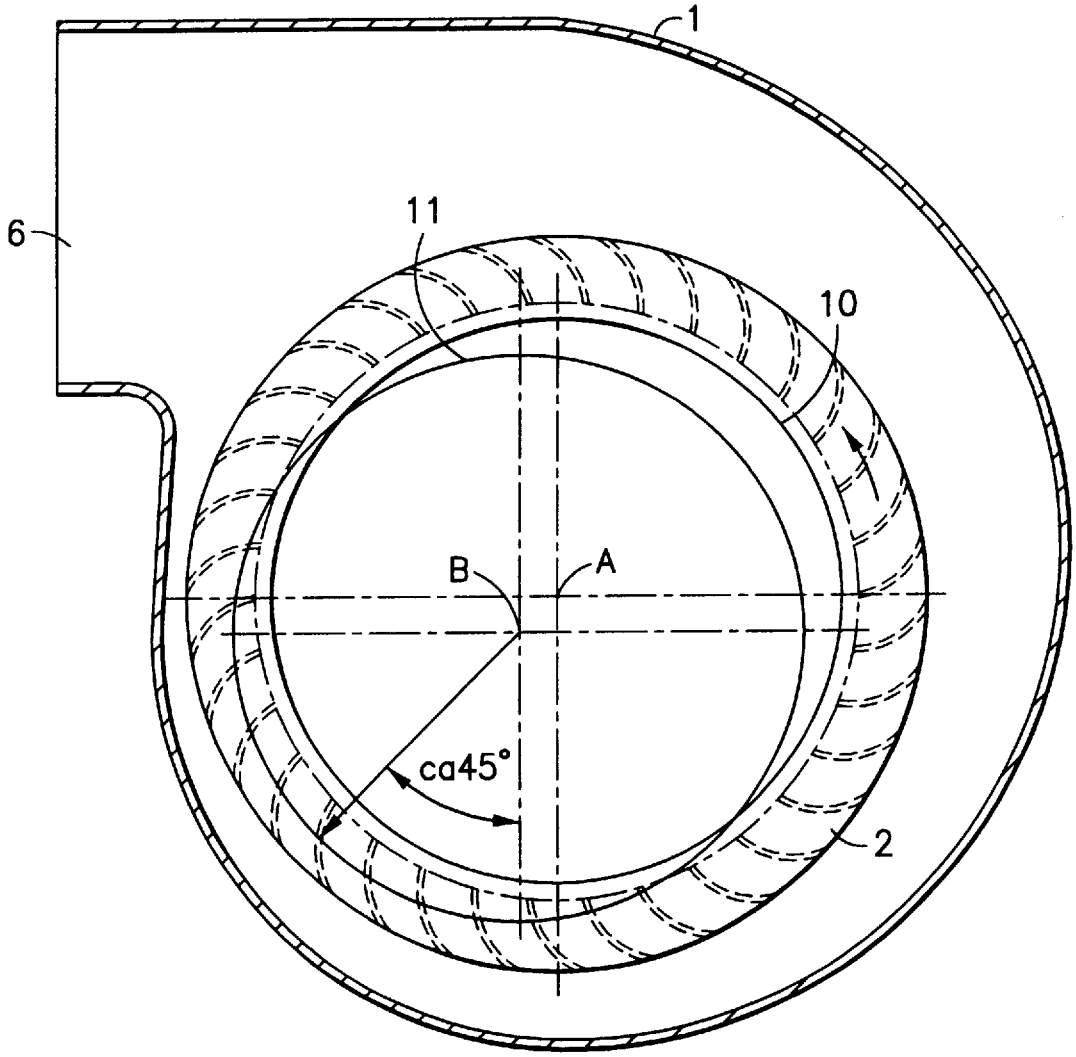

FIG. 6 shows the plan view on the intake side of the centrifugal fan having the nozzle inlet opening. In the known centrifugal fan, the nozzle inlet opening is disposed centrally to the inner circumference of the impeller 2, as represented by the circle 10. The center of the circle 10 is at A. In an exemplary embodiment of the centrifugal fan of the invention, the nozzle inlet opening is radially offset relative to the inner circumference of the impeller 2, as illustrated by the circle 11. The center of the circle 11 is at B.

The center B is radially offset from the center A in the first quadrant of the casing 1 downstream of the outlet opening 6 in the direction of rotation of the impeller 2. The distance between the centers A and B is approximately 5 to 10% of the impeller diameter.

The eccentric location of the nozzle inlet opening brings further improvement in the air capacity.

Various changes and modifications may be made, and features described in connection with any one of the embodiments may be used with any of the others, within the scope of the inventive concept.

We claim:

1. A centrifugal fan comprising:

a casing with a spiral-shaped outer contour;

at least one circular lateral inlet opening;

a tangential outlet opening;

a drum impeller rotatably mounted in the casing and coupled to an electric motor such that a pressure space having a volume is formed between a circumference of the drum impeller and an inner contour of the casing; and flat blades attached to the drum impeller;

wherein a shortest distance between the circumference of the drum impeller and the inner contour of the casing is approximately 1 to 5% of a diameter of the drum impeller;

wherein a location of the shortest distance between the circumference of the drum impeller and the inner contour of the casing is shifted from the outlet opening in a direction of rotation of the drum impeller; and wherein a distance between the circumference of the drum impeller and the inner contour of the casing is steadily increased from the location of the shortest distance therebetween toward the outlet opening to form a wedge-shaped space.

2. The centrifugal according to claim 1, wherein the diameter of the drum impeller is approximately 70 to 80% of a height of an inner scroll of the casing.

3. The centrifugal according to claim 1, wherein a blade angle of the flat blades is approximately 34 to 45 degrees.

4. The centrifugal according to claim 1, wherein the wedge-shaped space has a size of up to 30 angular degrees.

5. The centrifugal according to claim 1, wherein the inlet opening is positioned to be eccentric with respect to an internal circumference of the drum impeller.

6. A centrifugal fan comprising:

a casing with a spiral-shaped outer contour;

at least one circular lateral inlet opening;

a tangential outlet opening;

a drum impeller rotatably mounted in the casing and coupled to an electric motor such that a pressure space having a volume is formed between a circumference of the drum impeller and an inner contour of the casing; and flat blades attached to the drum impeller;

wherein a shortest distance between the circumference of the drum impeller and the inner contour of the casing is approximately 1 to 5% of a diameter of the drum impeller;

wherein a location of the shortest distance between the circumference of the drum impeller and the inner contour of the casing is shifted from the outlet opening in a direction of rotation of the drum impeller;

wherein a distance between the circumference of the drum impeller and the inner contour of the casing is steadily increased from the location of the shortest distance therebetween toward the outlet opening to form a wedge-shaped space; and wherein the diameter of the drum impeller is approximately 70 to 80% of a height of an inner scroll of the casing.

7. The centrifugal according to claim 6, wherein a blade angle of the flat blades is approximately 34 to 45 degrees.

8. The centrifugal according to claim 6, wherein the wedge-shaped space has a size of up to 30 angular degrees.

9. The centrifugal according to claim 6, wherein the inlet opening is positioned to be eccentric with respect to an internal circumference of the drum impeller.

10. A centrifugal fan comprising:

a casing with a spiral-shaped outer contour;

at least one circular lateral inlet opening;

a tangential outlet opening;

a drum impeller rotatably mounted in the casing and coupled to an electric motor such that a pressure space having a volume is formed between a circumference of the drum impeller and an inner contour of the casing; and flat blades attached to the drum impeller;

wherein a shortest distance between the circumference of the drum impeller and the inner contour of the casing is approximately 1 to 5% of a diameter of the drum impeller;

wherein a location of the shortest distance between the circumference of the drum impeller and the inner contour of the casing is shifted from the outlet opening in a direction of rotation of the drum impeller;

wherein a distance between the circumference of the drum impeller and the inner contour of the casing is steadily increased from the location of the shortest distance therebetween toward the outlet opening to form a wedge-shaped space; and wherein a blade angle of the flat blades is approximately 34 to 45 degrees.

11. The centrifugal according to claim 10, wherein the diameter of the drum impeller is approximately 70 to 80% of a height of an inner scroll of the casing.

12. The centrifugal according to claim 10, wherein the wedge-shaped space has a size of up to 30 angular degrees.

13. The centrifugal according to claim 10, wherein the inlet opening is positioned to be eccentric with respect to an internal circumference of the drum impeller.

* * * * *